US007340936B2

(12) United States Patent
Gregg

(10) Patent No.: US 7,340,936 B2
(45) Date of Patent: Mar. 11, 2008

(54) HANDHELD CRIMPING TOOL AND METHOD OF USING SAME

(75) Inventor: Ian Gregg, Poulsbo, WA (US)

(73) Assignee: Shear Tech, Inc., Kingston, WA (US)

( * ) Notice: Subject to any disclaimer, the term of this patent is extended or adjusted under 35 U.S.C. 154(b) by 10 days.

(21) Appl. No.: 11/152,667

(22) Filed: Jun. 13, 2005

(65) Prior Publication Data

US 2006/0277969 A1 Dec. 14, 2006

(51) Int. Cl.
*B21J 13/02* (2006.01)

(52) U.S. Cl. ..... 72/480; 72/413; 72/416; 72/453.15; 72/455; 29/751; 29/753

(58) Field of Classification Search ..... 72/404, 72/413, 416, 449, 453.15, 453.16, 455, 456; 29/751, 753

See application file for complete search history.

(56) References Cited

U.S. PATENT DOCUMENTS 2,892,368 A * 6/1959 Demler ..... 72/404
4,475,374 A * 10/1984 Sakai et al. ..... 72/452.5
4,914,941 A * 4/1990 Ijiri et al. ..... 72/449
5,553,478 A * 9/1996 Di Troia ..... 72/453.15
5,727,417 A * 3/1998 Moffatt et al. ..... 72/453.03
6,119,502 A * 9/2000 Buchmayer ..... 72/404
6,401,515 B2 * 6/2002 Frenken ..... 72/453.15
6,684,679 B2 * 2/2004 Hsieh ..... 72/453.15

* cited by examiner

*Primary Examiner*—David B Jones
(74) *Attorney, Agent, or Firm*—Perkins Coie LLP

(57) ABSTRACT

Apparatuses and methods for an improved handheld crimping tool for crimping a wire. The handheld crimping tool includes a head portion having a crimping device positioned adjacent a first end thereof. The crimping device may have an adjustable die cavity to facilitate crimping wires of various diameters. The crimping tool further includes a handle portion having a gripping portion suitably configured to be manually grasped. In one embodiment, the head portion is operable to be rotated relative to the handle portion to position the crimping device in a selected orientation and may be maintained in the selected orientation by a biasing mechanism. The crimping tool further includes a drive mechanism operable to actuate the crimping device. In one embodiment, the drive mechanism may be operable to convert rotational motion to reciprocating motion that generates a linear crimping motion in the crimping device.

22 Claims, 6 Drawing Sheets

HANDHELD CRIMPING TOOL AND METHOD OF USING SAME

TECHNICAL FIELD

This invention relates generally to handheld crimping tools. More specifically this invention generally relates to a handheld crimping tool having a handle portion and a head portion with a crimping device operable to be rotated relative to the handle portion in order to position the crimping device at a selected orientation.

BACKGROUND OF THE INVENTION

Crimping tools are used to attach electrical terminals to a wire by a process known as crimping so that the wire does not need to be soldered in order to electrically and mechanically couple it to an electrical device. Crimping tools are also commonly used for butt spicing wires together and capping the end of a wire. In order to crimp an electrical terminal to a wire, the insulation from the wire is stripped, and then the stripped wire is inserted in a metal ferrule or barrel that encloses the stripped wire and, typically, an insulated portion of the wire. A crimping tool then applies a compressive force to the barrel to press and permanently deform the barrel so that it is secured to the wire contained therein. This deformation process creates an electrically conductive and mechanically strong connection between the barrel and the stripped wire.

There are a number of crimping tools known in the art that can be used to crimp an electrical terminal to a wire. For example, manually operable crimping tools and crimping tools that employ an electric motor to drive the crimping tool are known in the art.

However, there is always a continual need to improve crimping tools so that they are more ergonomic, user friendly, and facilitate crimping in a variety of orientations. It would also be desirable that such crimping tools are adaptable for use with a variety of different crimping devices, and can crimp wires of various diameters.

SUMMARY OF THE INVENTION

The invention is directed to an improved handheld crimping tool for crimping a wire and methods of using the handheld crimping tool. The handheld crimping tool includes a head portion having a crimping device positioned adjacent a first end thereof and a handle portion having a gripping portion suitably configured to be manually grasped. The handheld crimping tool further includes a drive mechanism operable to actuate the crimping device. In one aspect of the invention, the head portion is operable to be rotated relative to the handle portion to position the crimping device in a selected orientation. In another aspect of the invention, the drive mechanism may be operable to impart a linear, reciprocating crimping motion to the crimping device that prevents disengagement of a wire positioned within a die cavity of the crimping device until the crimping deformation has been completed.

DETAILED DESCRIPTION OF THE EMBODIMENTS

The invention is generally directed to handheld crimping tools and methods of using handheld crimping tools. Many specific details of certain embodiments of the invention are set forth in the following description and in FIGS. 1 through 7 in order to provide a thorough understanding of such embodiments. One skilled in the art, however, will understand that the invention may have additional embodiments, or that the invention may be practiced without several of the details described in the following description.

Figure 1:
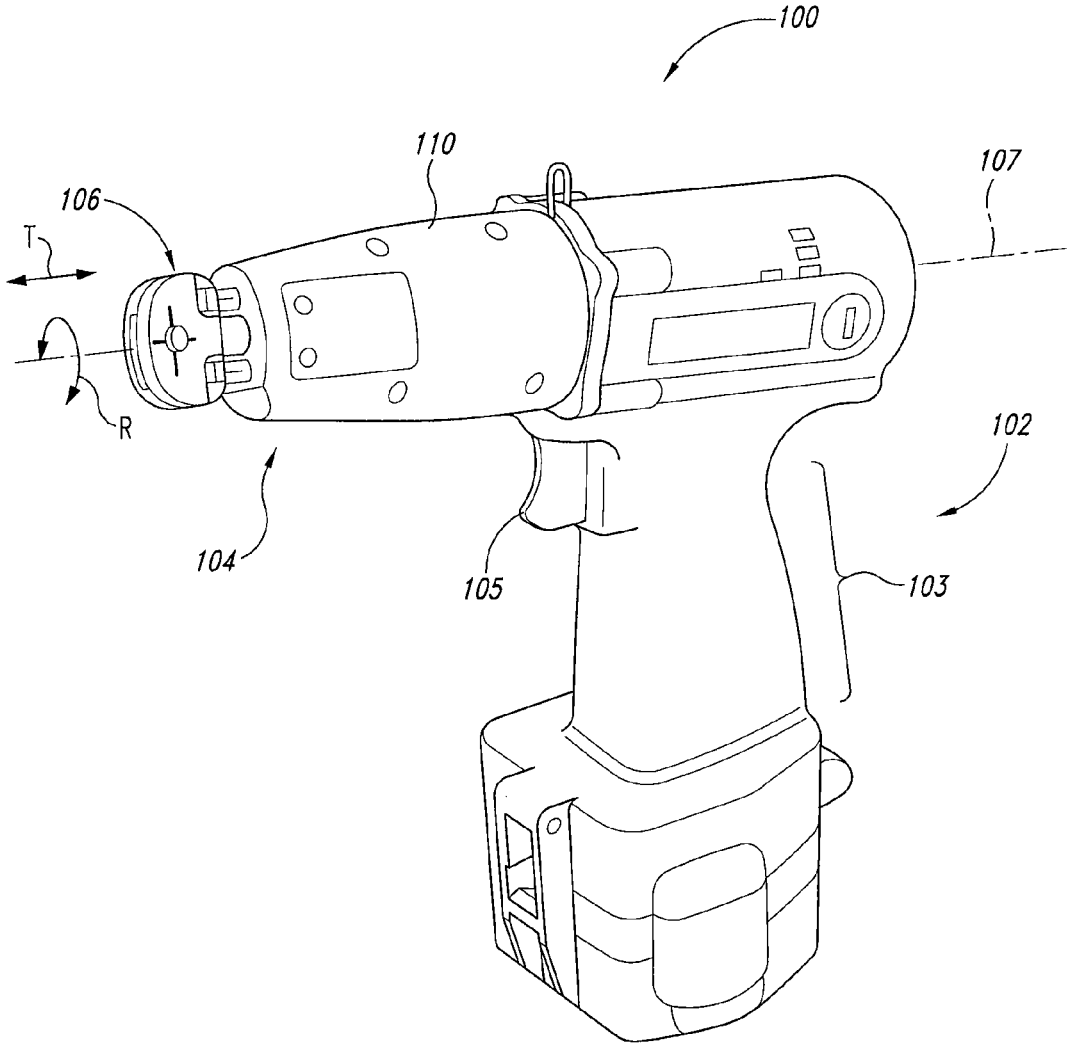
FIG. 1 is an isometric view of a crimping tool according to one embodiment of the invention.

FIG. 1 shows a handheld crimping tool 100 according to one embodiment of the invention. The crimping tool 100 has a handle portion 102 rotatably coupled to a head portion 104. The handle portion 102 includes a gripping portion 103 projecting in a downward direction that is suitably configured for a user's hand to easily grasp and pull a trigger 105 to activate the crimping tool 100. The handle portion 102 may be hollow and configured with provisions to hold part of the drive mechanism that drives the crimping device, and a rechargeable battery and motor for powering the drive mechanism. The drive mechanism is not shown in FIG. 1, however, it will be discussed in more detail with respect to FIGS. 3 through 5 below. The head portion 104 includes a housing 110 that encloses and supports part of the drive mechanism that actuates a crimping device 106 located at an end thereof. The head portion 104 is rotatably coupled to the handle portion 102 so that it may be extended in the direction T away from the front of the handle portion 102 to disengage it from the handle portion 102 and rotated about a longitudinal axis 107 of the crimping tool 100 in the direction R to selectively orient the crimping device 106.

Figure 2:
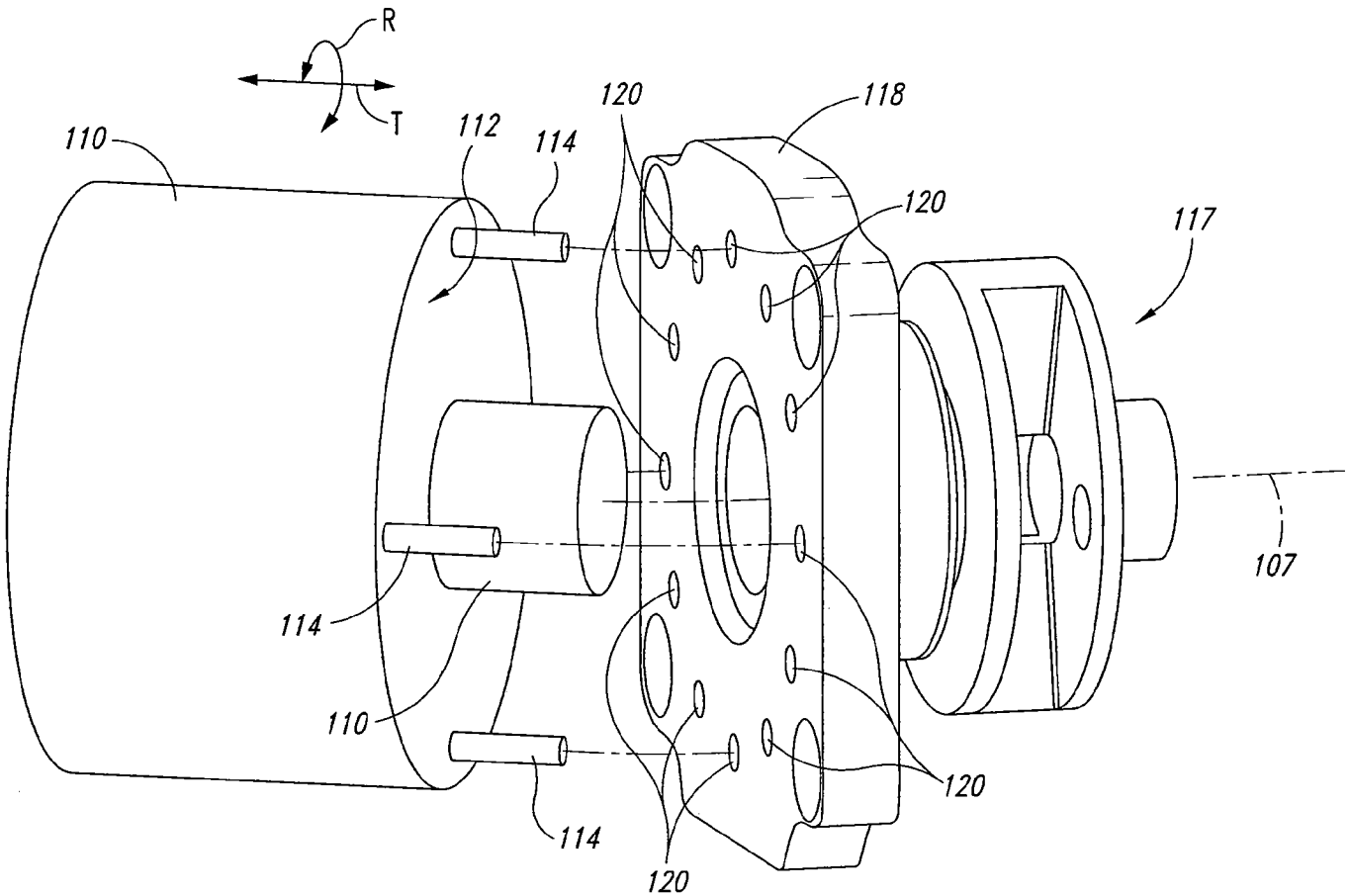
FIG. 2 is a partial isometric view of the crimping tool of FIG. 1 with the head portion retracted away from the handle portion to a position where the alignment pins of the head portion are disengaged from the handle portion allowing the head portion to be rotated relative to the handle portion to selectively orient the crimping device according to one embodiment of the invention.

FIG. 2 illustrates how the head portion 100 may be rotated about the longitudinal axis 107 relative to the handle portion 102 to selectively orient the crimping device 106 associated with the head portion 104. The ability to change the orientation of the crimping device 106 is desirable because it enables the user to perform crimping operations in locations that are difficult to reach or that would ordinarily require orienting the entire crimping tool 100 at an awkward position for the user. This feature is particularly important because, the handle portion 102 might otherwise project into an adjacent object when an attempt is made to rotate the head portion 104 to the proper angle for crimping. In order to change the orientation of the crimping device 106, the user manually grips the housing 110 of the head portion 104 and pulls the head portion 104 in the direction T to disengage alignment pins 114, which are attached to and projecting from rear section 112 of the head portion 104, from a set of corresponding holes 120 disposed in a circular pattern and drilled into a front plate 118 of handle portion 102. Once the alignment pins 114 are disengaged from the front plate 118, the head portion 104 may be rotated about a drive shaft 116, which forms part of the drive mechanism, until the alignment pins 114 are aligned with a different set of corresponding holes 120 corresponding to a different rotational orientation for the crimping device 106. The head portion 104 is then allowed retract under actuation of a biasing mechanism associated with the drive mechanism so that the alignment pins 114 are received by a new set of corresponding holes 120.

In one embodiment, the detent mechanism that maintains the head portion 104 in engagement with the handle portion 102 may be characterized as a variable force detent mechanism that requires a relatively high force to disengage the alignment pins 114 of the head portion 104 from the corresponding holes 120 of the handle portion 102 and once disengaged, the force needed to relatively move the head portion 104 in the direction T is relatively less. It is currently believed that this variable force detent mechanism is created by the combination of compression of a compression spring 144, which is not shown in FIG. 2 and shown in FIG. 5, static friction between the alignment pins 114 and the internal surfaces of the corresponding holes 120, and a vacuum that is initially developed in the holes 120 caused by the removal of the alignment pins 114 from the holes 120. Different configurations may be used to selectively position the head portion 104 relative to the handle portion 102. For example, the alignment pins 114 may be attached to and projecting from the front plate 118 and corresponding holes 120 may be formed in the rear section 112 of the head portion 104 or another suitable configuration. Furthermore, only three alignment pins 114 are used in the embodiment shown in FIG. 2, however, more or less than three of the alignment pins 114 may be used. The variable force detent mechanism securely holds the head portion 104 against the handle portion 102 during use, but when the head portion 104 is pulled axially away from the handle portion 102, very little force is required to hold the head portion 104 away from the handle portion 102. As a result, it is relatively easy to rotate the head portion 104 because it is not necessary to apply a great deal of axial force to the head portion 104 while it is being rotated.

Figure 3:
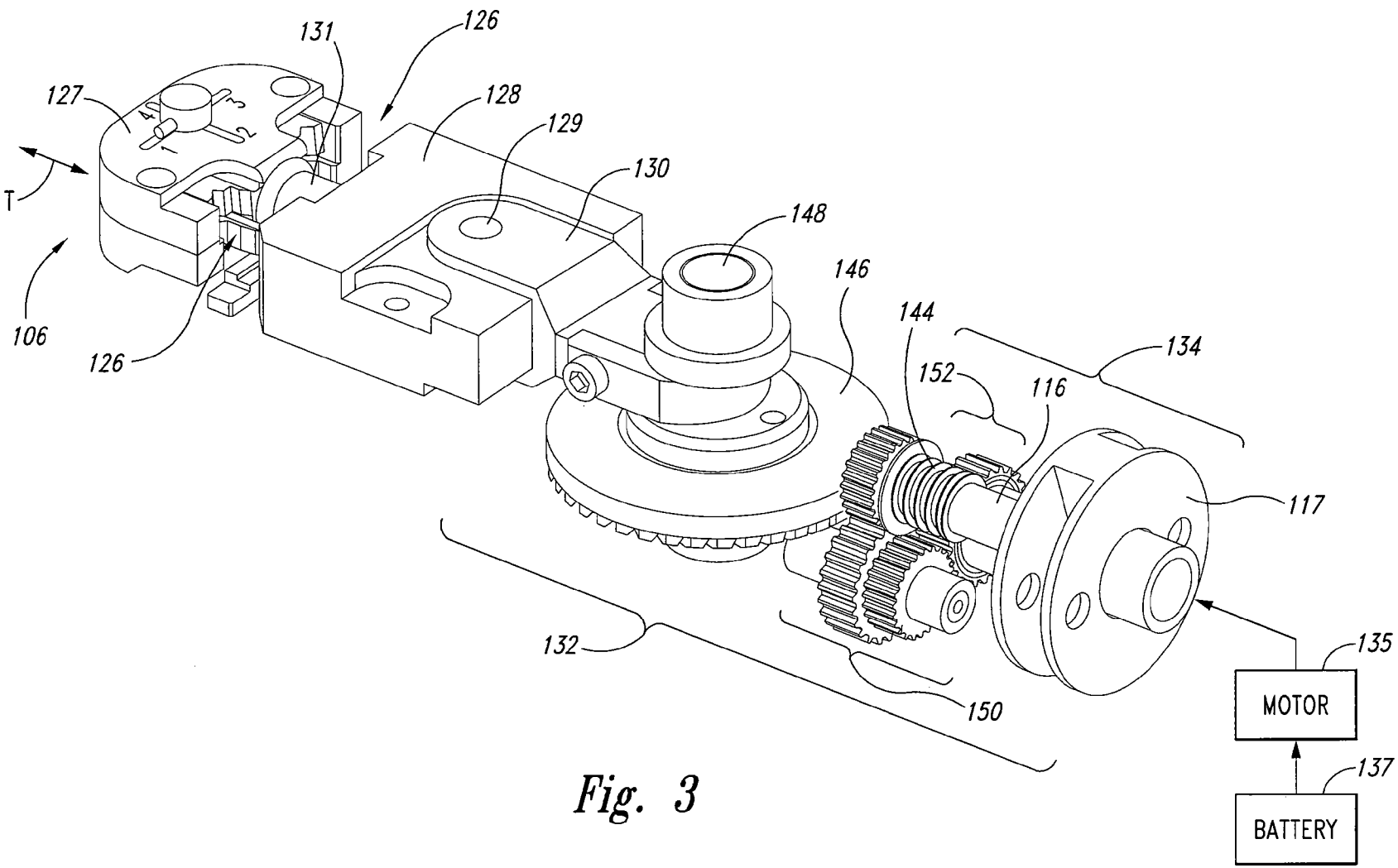
FIG. 3 is a top isometric view of the drive mechanism for converting rotational motion to linear, reciprocating crimping motion in the crimping device according to one embodiment of the invention.
Figure 4:
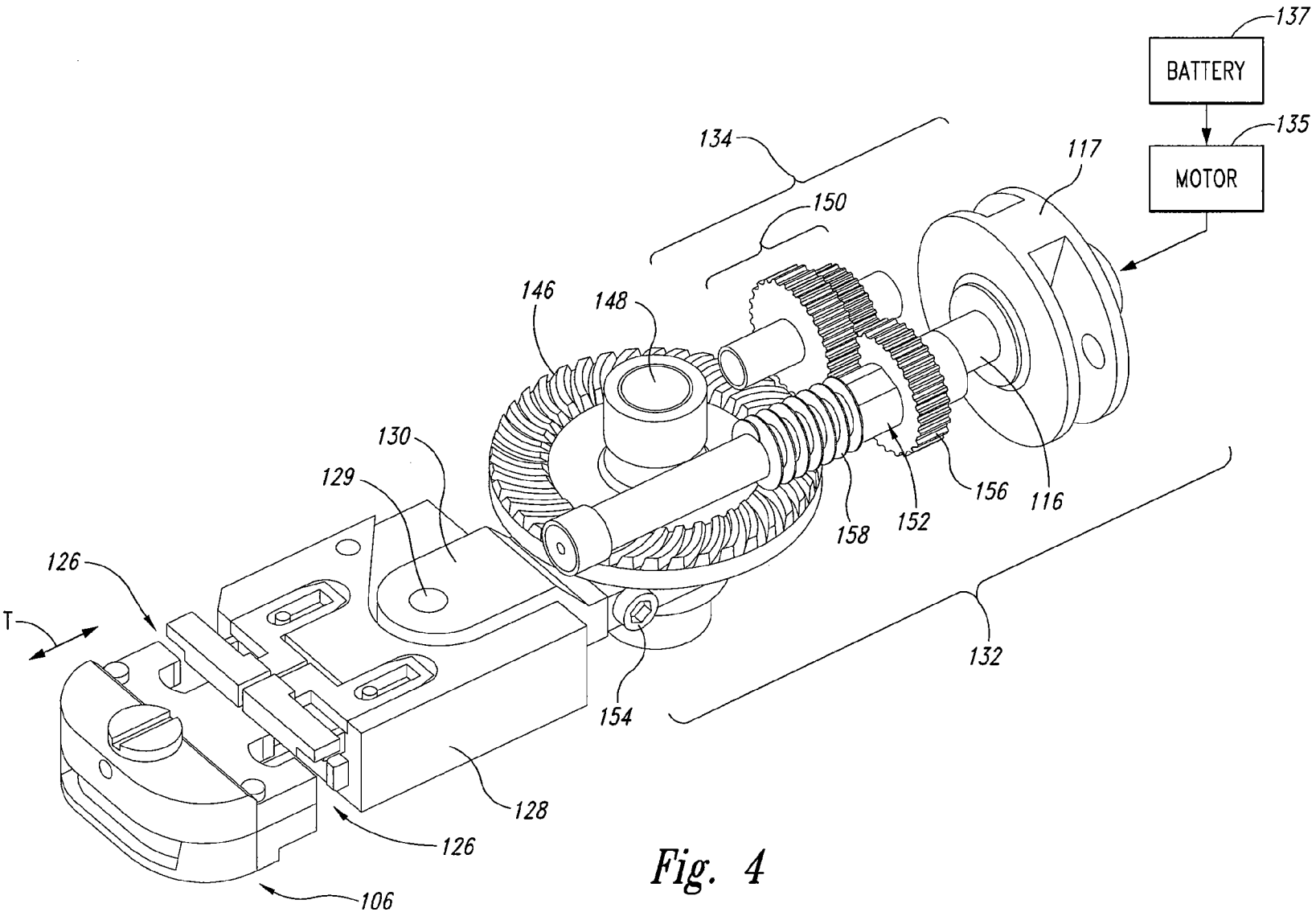
FIG. 4 is a bottom isometric view of the drive mechanism and the crimping device shown in FIG. 3.

FIGS. 3 and 4 show one embodiment that may be used for the drive mechanism that actuates the crimping device 106. Drive mechanism 132 is configured to convert rotational motion of an electric motor 135 to linear, reciprocating crimping motion in the crimping device 106. The electric motor 135 is powered by a battery 137, and operably coupled to the drive mechanism 132 via a gear mechanism 134. The gear mechanism 134 includes a drive shaft 116 having a hub 117. In operation, the electric motor 135 rotates the hub 117 and the drive shaft 116 to engage a gear mechanism 150 and effect rotation thereof. Rotation of the gear mechanism 150 and engagement with a gear mechanism 152, in-turn, causes rotation of the gear mechanism 152. The gear mechanism 152 includes a shaft 154 having a pinion gear 156 that engages a pinion gear of the gear mechanism 150. The gear mechanism 152 further includes a pinion gear 158 that engages a large helical gear 146 and effects rotation thereof. A linkage 130 is pivotally attached to a shaft 148 that is connected to and supports the large helical gear 146. The linkage 130 is connected to the shaft 148 at a off-center position relative to the large helical gear 146. The linkage 130 is also pivotally attached to a crimping device shaft 131 that extends through a crimping body 128 using a fastener 129.

Rotation of the large helical gear 146 causes the linkage 130 to move the crimping device shaft 131 in a linear, reciprocating manner. The linear, reciprocating motion of the crimping device drive shaft 131 linearly translates crimping head 127 of the crimping device 106 in direction T, while the crimping body 128 remains stationary. The linear, reciprocating motion of the crimping head 127 moves the crimping head 127 toward the crimping body 128 so that die cavities 126 close to crimp a wire and electrical terminal placed therein, and eventually returns to its retracted, open position shown in FIGS. 6 and 7 so that the crimped wire may be removed. By translating the crimping head 127 in a linear, reciprocating manner, the wire is completely crimped before the user may remove it from the crimping cavity 126. In other words, the user cannot remove the crimped wire before the crimping device 106 completes the crimping deformation process without activating an override safety switch that retracts the crimping head 127 to the open position shown in FIGS. 6 and 7. Other drive mechanisms that convert rotational motion to linear, reciprocating motion may also be used such as, for example, a rack and pinion type drive mechanism or another suitable drive mechanism. Furthermore, in additional embodiments, the drive mechanism may be pneumatically or hydraulically actuated instead of using the electric motor 135.

Figure 5:
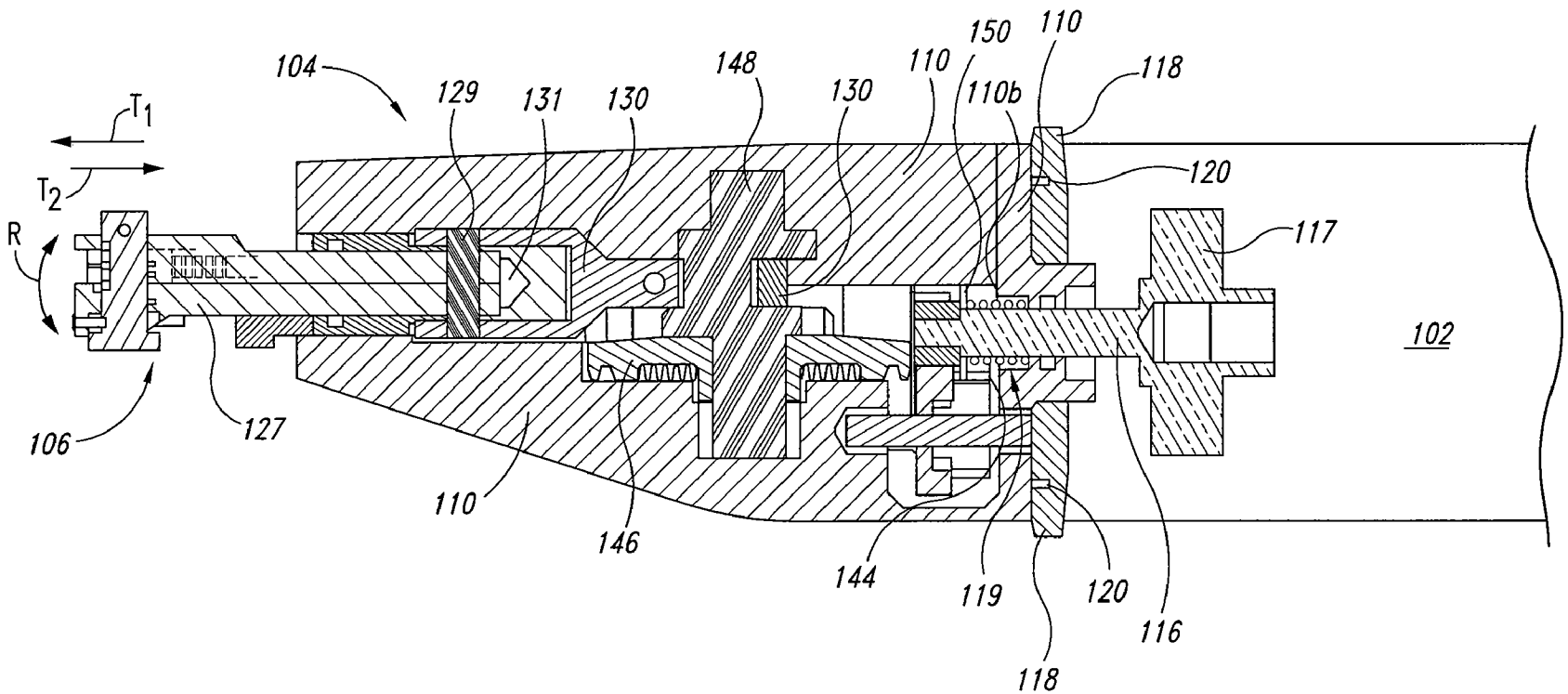
FIG. 5 is a partial side elevation view of the drive mechanism and the crimping device shown in FIGS. 3 and 4 according to one embodiment of the invention.
Figure 6:
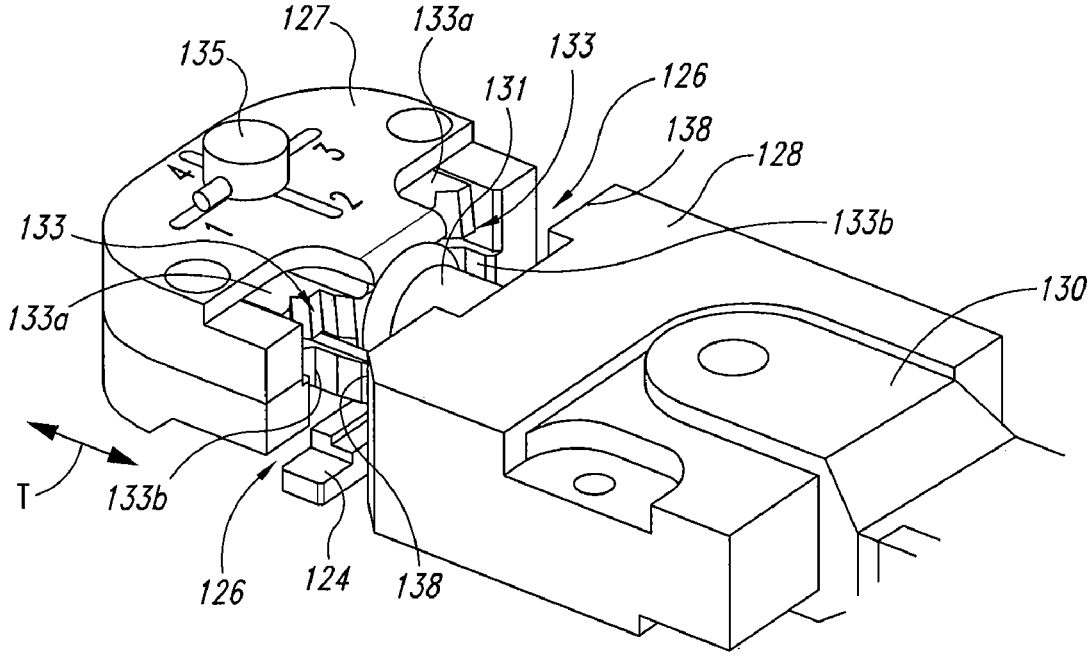
FIG. 6 is an enlarged top isometric view of the crimping device shown in FIGS. 1 and 3 through 5.
Figure 7:
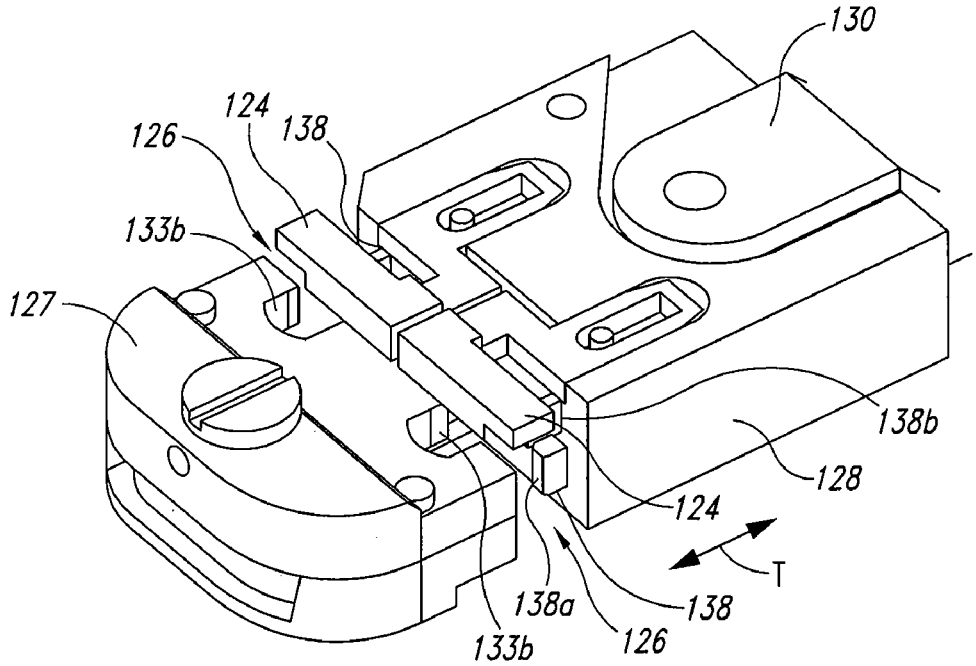
FIG. 7 is an enlarged bottom isometric view of the crimping device shown in FIGS. 1 and 3 through 5.

Turning now to FIG. 5, the detent mechanism that maintains the head portion 104 in engagement with the handle portion 106 is most clearly shown. The drive shaft 116 of the drive mechanism 132 includes a compression spring 144 that provides a restoring force for returning the head portion 104 back into engagement with the handle portion 102 after the user has pulled the head portion 104 and the handle portion 102 apart from each other. The head portion 104 is configured and operable to slide in direction $T_1$ along the drive shaft 116 resulting in compression of the compression spring 144. The distance that the head portion is able to slide along the drive shaft 116 is determined by the standoff between housing portion 110*b* and a washer 150. When the user releases the head portion 104, the compression spring 144 biases the head portion 104 toward the handle portion 102 in the direction $T_2$ and into engagement therewith.

Another aspect of the drive mechanism 132 that is most clearly shown in FIG. 5 is that the portion of the drive mechanism 134 that is operable to convert rotational motion to linear, reciprocating motion is contained partially in the handle portion 102 and partially in the head portion 104. This enables that the head portion 104 may be linearly translated in the direction $T_1$ along the drive shaft 116 to disengage the handle portion and enables that the head portion 104 may be rotated about the drive shaft 116 in the direction R to selectively orient the crimping device 106.

A number of different crimping devices may be used as the crimping device 106. However, in one embodiment shown in FIGS. 6 and 7, the crimping device 106 is configured as an adjustable, linear crimping device having a T-shaped head configuration suitable for crimping wires of various diameters. One example of a suitable crimping device is the "T-Head" manually operable crimping tool 59250, which is commercially available from Tyco Electronics®. The crimping device 106 includes the crimping head 127 that is moveable relative to the crimping body 128 in the direction T. The crimping head 127 includes a pair of dies 133 that in conjunction with opposing dies 138 of the crimping body 128 defines the respective die cavities 126.

The crimping device 106 further includes respective alignment bars 124 that are attached to the bottom of the crimping body 128 and positioned below the crimping head 127 and die cavities 126 so that the crimping head 127 may move toward the dies 138 to close the die cavities 126 without physical interference with the alignment bars 124. The alignment bars 124 are located directly below corresponding die cavities 126 when the crimping head 127 is in its retracted, open position. Each of the dies 133 is formed of two die portions, an upper die portion 133*a* and an lower die portion 133*b* and each of the opposing dies 138 is formed of an upper die portion 138*a* and a lower die portion 138*b*. Each of the upper die portions 133*a* is adjustable using a manually operable adjustment mechanism 135 (shown to have 4 settings "1, 2, 3, 4") to vary the standoff between the upper die portion 133*a* and its corresponding opposing die 138. This enables the crimping device 106 to accommodate a variety of different wire diameters and insulation thicknesses, while the die volume between the lower die portions 133*b* and the opposing lower die portions 138*b* that compresses an electrical terminal to the stripped portion of a wire is not adjustable.

The crimping tools disclosed herein provide the user with an ergonomic "pistol grip" type handle allowing the user to easily position the crimping device in a desired orientation. Furthermore, the ability to adjust the orientation of the crimping device relative to the handle makes the crimping tool even more user friendly because the orientation of the crimping device may be adjusted to crimp wires in awkward or difficult to reach positions. Additionally, the above ergonomic features in conjunction with employing an adjustable crimping device provides a crimping tool that is easy to use, adaptable to a variety of work environments, and can reliably crimp wires of different diameters.

Although the invention has been described with reference to the disclosed embodiments, persons skilled in the art will recognize that changes may be made in form and detail without departing from the spirit and scope of the invention. For example, a variety of different crimping devices may employed with the crimping tool described herein. Additionally, a variety of different drive mechanisms and power systems may be used to actuate the crimping device of the crimping tool. Such modifications are well within the skill of those ordinarily skilled in the art. Accordingly, the invention is not limited except as by the appended claims.

What is claimed is:

1. A handheld crimping tool for crimping a wire, comprising:

a head portion having a crimping device positioned adjacent a first end thereof;

a handle portion having a gripping portion suitably configured to be manually grasped, the head portion operable to be rotated relative to the handle portion to position the crimping device in a selected orientation;

a drive mechanism operable to actuate the crimping device;

wherein the head portion comprises a first attachment portion distal from the first end configured to engage an opposing second attachment portion of the handle portion; and wherein the first attachment portion comprises a plurality of projections configured to be received by corresponding holes in the second attachment portion.

2. The handheld crimping tool of claim 1 wherein the plurality of holes are arranged so that the projections can engage a different set of the holes when the head portion is rotated relative to the handle portion.

3. The handheld crimping tool of claim 1 wherein the plurality of holes are arranged in a circular pattern.

4. The handheld crimping tool of claim 1 wherein the drive mechanism is operable to convert rotational motion to linear, reciprocating crimping motion in the crimping device.

5. The handheld crimping tool of claim 4 wherein at least a portion of the section of the drive mechanism operable to convert rotational motion to linear, reciprocating motion is located within the handle portion.

6. The handheld crimping tool of claim 4 wherein a portion of the section of the drive mechanism operable to convert rotational motion to linear, reciprocating motion is located partially within the head portion and partially within the handle portion.

7. The handheld crimping tool of claim 4 wherein the drive mechanism is operable so that the linear, reciprocating crimping motion of the crimping device does not begin to disengage a wire positioned within a die cavity of the crimping device until crimping deformation is completed.

8. The handheld crimping tool of claim 1 further comprising an electric motor operably coupled to the drive mechanism.

9. The handheld crimping tool of claim 1 further comprising a pneumatic or hydraulic actuation system operably coupled to the drive mechanism.

10. The handheld crimping tool of claim 1 wherein the crimping device comprises at least one adjustable die cavity.

11. The handheld crimping tool of claim 1 wherein the head portion extends from the handle portion in a first direction, and wherein the gripping portion has a longitudinal axis that extends in a direction that is generally perpendicular to the first direction.

12. A handheld crimping tool for crimping a wire, comprising:

a head portion having a crimping device positioned adjacent a first end thereof;

a handle portion having a gripping portion suitably configured to be manually grasped, the head portion operable to be rotated relative to the handle portion to position the crimping device in a selected orientation;

a drive mechanism operable to actuate the crimping device; and a detent mechanism operable to bias the head portion toward the handle portion.

13. The handheld crimping tool of claim 12 wherein the detent mechanism is configured to provide a variable resistance force when the head portion and the handle portion are pulled apart from each other.

14. The handheld crimping tool of claim 13 wherein the variable resistance force comprises a relatively greater initial force to initiate disengagement of the head portion from the handle portion followed by a relatively lower force required to continue displacement of the head portion relative to the handle portion.

15. The handheld crimping tool of claim 12 wherein the detent mechanism comprises a compression spring operable to bias the head portion and the handle portion toward each other.

16. A method of orienting a crimping device of a crimping tool, the crimping tool having a head portion including the crimping device and a handle portion including a gripping portion, the method comprising:

disengaging the head portion from the handle portion;

relatively rotating the head portion and the handle portion to a first rotational position;

engaging the head portion with the handle portion to secure the crimping device at the first rotational position, and wherein the act of disengaging the head portion from the handle portion comprises removing projections of the head portion from corresponding recesses in the handle portion.

17. The method of claim 16 wherein the act of disengaging the head portion from the handle portion comprises applying a first force to initiate disengagement of the head portion from the handle portion and continuing displacement of the head portion relative to the handle portion by applying a second force that is less than the first force.

18. The method of claim 16 wherein the act of relatively rotating the head portion and the handle portion to a first rotational position comprises aligning a plurality of projections of the head portion with corresponding recesses of the handle portion.

19. The method of claim 16 wherein the act of engaging the head portion with the handle portion to secure the crimping device at the first rotational position comprises biasing the head portion and handle portion toward each other.

20. The method of claim 16, further comprising altering the size of a die cavity of the crimping device.

21. A method of orienting a crimping device of a crimping tool, the crimping tool having a head portion including the crimping device and a handle portion including a gripping portion, the method comprising:

disengaging the head portion from the handle portion;

relatively rotating the head portion and the handle portion to a first rotational position;

engaging the head portion with the handle portion to secure the crimping device at the first rotational position, and wherein the act of engaging the head portion with the handle portion to secure the crimping device at the first rotational position comprises aligning and inserting projections of the head portion into corresponding recesses of the handle portion.

22. A method of orienting a crimping device of a crimping tool, the crimping tool having a head portion including the crimping device and a handle portion including a gripping portion, the method comprising:

disengaging the head portion from the handle portion;

relatively rotating the head portion and the handle portion to a first rotational position;

engaging the head portion with the handle portion to secure the crimping device at the first rotational position;

crimping a first wire using the crimping device when the crimping device is positioned at the first rotational position;

relatively rotating the head portion and the handle portion to a second rotational position;

engaging the head portion with the handle portion to secure the crimping device at the second rotational position; and crimping a second wire using the crimping device when the crimping device is positioned at the second rotational position.

* * * * *